US010006689B2

(12) United States Patent
Chase et al.

(10) Patent No.: US 10,006,689 B2
(45) Date of Patent: Jun. 26, 2018

(54) MODULAR BUCKET AND DOOR ARCHITECTURE TO DELIVER THREE ICE FUNCTIONS

(71) Applicant: WHIRLPOOL CORPORATION, Benton Harbor, MI (US)

(72) Inventors: Kevin M. Chase, St. Joseph, MI (US); Tony L. Koenigsknecht, Austin, TX (US); Kate E. Presnell, St. Joseph, MI (US); Jerold M. Visin, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 212 days.

(21) Appl. No.: 14/979,706

(22) Filed: Dec. 28, 2015

(65) Prior Publication Data

US 2016/0131407 A1 May 12, 2016

Related U.S. Application Data

(63) Continuation of application No. 12/636,953, filed on Dec. 14, 2009, now Pat. No. 9,310,124.

(51) Int. Cl.

| | |
|---|---|
| ***F25C 1/14*** | (2018.01) |
| ***F25C 5/00*** | (2018.01) |
| ***F25D 23/04*** | (2006.01) |
| ***F25C 5/02*** | (2006.01) |
| ***F25C 5/182*** | (2018.01) |
| ***F25C 5/20*** | (2018.01) |
| *F25C 5/04* | (2006.01) |
| *F25C 5/12* | (2006.01) |

(52) U.S. Cl.

CPC ..... *F25C 5/005* (2013.01); *F25C 5/02* (2013.01); *F25C 5/182* (2013.01); *F25C 5/22* (2018.01); *F25D 23/04* (2013.01); *F25C 5/046* (2013.01); *F25C 5/12* (2013.01); *F25C 2400/08* (2013.01); *F25C 2400/10* (2013.01); *Y10T 29/49826* (2015.01)

(58) Field of Classification Search

CPC .. F25C 5/005; F25C 5/002; F25C 5/02; F25C 5/182; F25C 5/046; F25C 2400/08; F25C 5/12

See application file for complete search history.

(56) References Cited

U.S. PATENT DOCUMENTS

| | | | |
|---|---|---|---|
| 4,228,934 | A | 10/1980 | Carr |
| 4,972,999 | A | 11/1990 | Grace |
| 5,056,688 | A | 10/1991 | Goetz et al. |

(Continued)

*Primary Examiner* — Elizabeth Martin

(74) *Attorney, Agent, or Firm* — Price Heneveld LLP

(57) ABSTRACT

An appliance including an ice manipulation reservoir capable of receiving ice having a base, wherein the base includes a first level and a second level, with the first level descending gradually to the second level. A first ice modification member is disposed inside the ice manipulation reservoir adjacent the first level of the base, and a second ice modification member is disposed inside the ice manipulation reservoir adjacent the second level of the base. A motor is operably connected with the ice manipulation reservoir and includes an output shaft. An impeller is connected with the output shaft proximate to the plurality of ice modification members, with the impeller being operable between a first directional rotation, and a second directional rotation.

20 Claims, 13 Drawing Sheets

(56) References Cited

U.S. PATENT DOCUMENTS

| | | | | |
|---|---|---|---|---|
| 5,513,810 | A | 5/1996 | Lin | |
| 6,050,097 | A | 4/2000 | Nelson et al. | |
| 7,134,620 | B1 * | 11/2006 | Lee | F25C 5/12 241/37.5 |
| 7,185,507 | B2 | 3/2007 | Maglinger et al. | |
| 7,278,275 | B2 | 10/2007 | Voglewede et al. | |
| 7,287,713 | B2 | 10/2007 | Akuzawa et al. | |
| 7,296,459 | B2 | 11/2007 | Son et al. | |
| 7,340,905 | B2 | 3/2008 | An | |
| 7,373,789 | B2 | 5/2008 | Oh et al. | |
| 7,395,672 | B2 | 7/2008 | Krause et al. | |
| 7,481,387 | B2 | 1/2009 | Lee et al. | |
| 7,762,097 | B2 | 7/2010 | Jeong et al. | |
| 2006/0059939 | A1 | 3/2006 | An et al. | |
| 2006/0207270 | A1 * | 9/2006 | Voglewede | F25C 5/005 62/135 |
| 2007/0199406 | A1 | 8/2007 | Ramirez, Jr. et al. | |
| 2007/0199407 | A1 | 8/2007 | Ramirez et al. | |

* cited by examiner

MODULAR BUCKET AND DOOR ARCHITECTURE TO DELIVER THREE ICE FUNCTIONS

CROSS-REFERENCE TO RELATED APPLICATION

The present application is a continuation of U.S. patent application Ser. No. 12/636,953 filed Dec. 14, 2009, entitled MODULAR BUCKET AND DOOR ARCHITECTURE TO DELIVER THREE ICE FUNCTIONS, the entire disclosure of which is hereby incorporated herein by reference.

BACKGROUND

Appliances are known for dispensing ice in various forms, such as ice cubes, crushed ice, and shaved ice. Some appliances that dispense ice in that fashion are domestic refrigeration appliances such as combined refrigerator/freezer appliances where the various forms of ice are delivered through the door of the appliance. While appliances generally do a good job of providing various forms of ice, there are limitations on being able to deliver three forms of ice from a single well. The provision of various forms of ice with multiple wells is limited to the spatial restraints of the appliance.

SUMMARY

One object of the present device is to provide an appliance including an ice manipulation reservoir capable of receiving ice having a base, wherein the base includes a first level and a second level, with the first level descending gradually to the second level. A first ice modification member is disposed inside the ice manipulation reservoir adjacent the first level of the base, and a second ice modification member is disposed inside the ice manipulation reservoir adjacent the second level of the base. A motor is operably connected with the ice manipulation reservoir and includes an output shaft. An impeller is connected with the output shaft proximate to the plurality of ice modification members, with the impeller being operable between a first directional rotation, and a second directional rotation.

Another object of the present device is to provide an ice modification mechanism. The mechanism includes an ice manipulation reservoir having a base, wherein the base includes a first level and a second level, the first level descending gradually to the second level. At least one ice modification component is disposed inside the ice manipulation reservoir. The at least one ice modification component is disposed substantially between the first level and the second level of the base. A motor is operably connected with the ice manipulation reservoir and includes an output shaft. An impeller is connected with the output shaft proximate to the at least one ice modification component, the impeller being operable between a first directional rotation, and a second directional rotation.

A further object of the present device includes a method of making an ice modification mechanism. An ice manipulation reservoir is provided with a base. A first level and a second level are formed in the base, wherein the first level descends gradually to the second level. At least one ice modification component is installed laterally between the first level of the base and the second level of the base. A motor having an output shaft is connected to an impeller by the output shaft and the impeller is extended into the ice manipulation reservoir.

Additional objects, features, and advantages of the present device will become more readily apparent from the following detailed description of the preferred embodiments when taken in conjunction with the drawings, wherein like reference numerals refer to corresponding parts in the several views.

DETAILED DESCRIPTION OF EMBODIMENTS

For purposes of description herein, the terms "upper," "lower," "right," "left," "rear," "front," "vertical," "horizontal," and derivatives thereof shall relate to the refrigerator having a secondary cooling loop, and method thereof. However, it is to be understood that the device may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
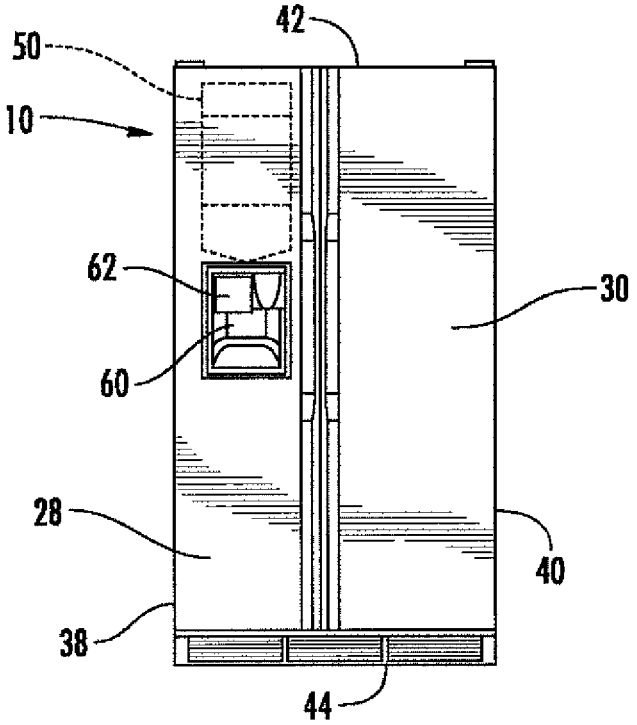
FIG. 1 is a front elevational view of an appliance having an ice manipulation module.
Figure 2:
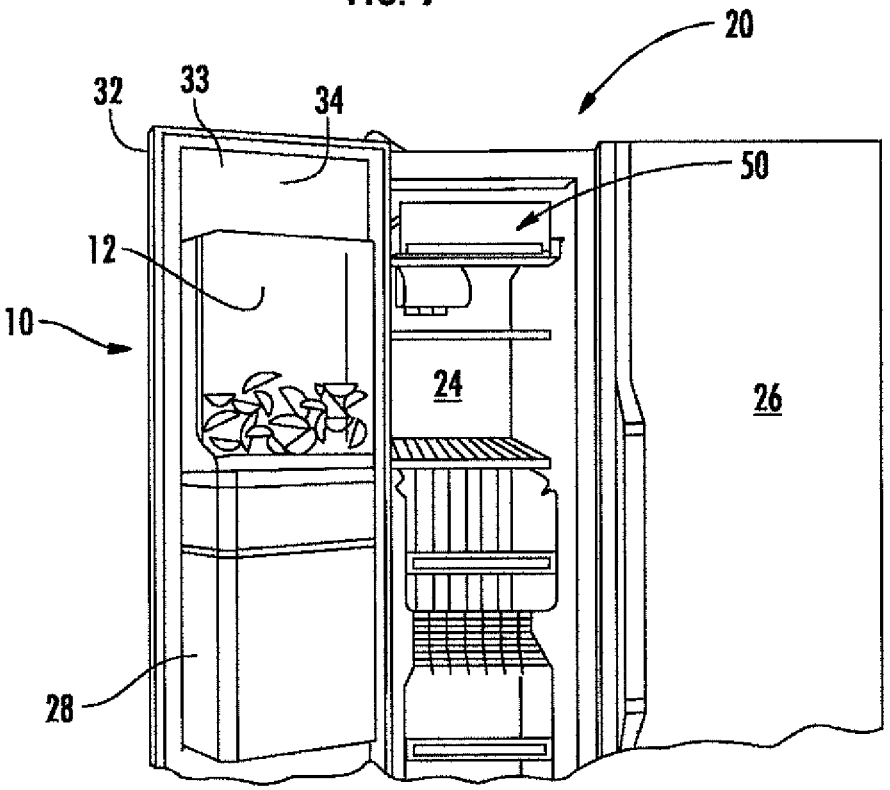
FIG. 2 is a front elevational view of the appliance having a freezer compartment and an above-freezing compartment.

Referring to FIGS. 1 and 2, the reference number 10 generally designates an ice manipulation module that includes a housing 11 adapted for removable connection with a module-receiving cavity 33. At least one ice modification member 70 or 72 is disposed inside the housing 11. A motor 90 is operably connected with the ice manipulation module 10 and includes an output shaft 92 that extends into the ice manipulation module 10. An impeller 76 is connected with the output shaft 92 proximate to the at least one ice modification member 70, 72, the impeller 76 being operable between a first ice manipulating condition defined by a first directional rotation A, and a second ice manipulating condition defined by a second directional rotation B.

The present invention provides various ice manipulation modules 10 for delivering ice in each of the three selected forms, namely, cubed, crushed, and shaved. Generally, as used herein, ice cubes or bodies of ice having a three dimensional (3D) shape, wherein a length in any of the dimensions is typically not less than about two centimeters (2 cm). Shaved ice comprises bodies of ice having a three dimensional (3D) shape, in which at least one of the dimensions has a length of no greater than about five millimeters (5 mm). Crushed ice comprises bodies of ice having a three dimensional (3D) shape, in which at least one of the dimensions has a length greater than about five millimeters (5 mm), but less than about two centimeters (2 cm), and no dimension has a length greater than about five centimeters (5 cm).

This ice manipulation module 10 can be arranged within an appliance 20, such as a domestic refrigerator having a refrigerated compartment, or other types of appliances, including freezers and ice makers. In the illustrated embodiment, as shown in FIGS. 1 and 2, a refrigerator 20 includes a cabinet forming a freezer compartment 24 and an above-freezing refrigeration compartment 26. Both the freezer compartment 24 and the above-freezing refrigeration compartment 26 are provided with access openings. A freezer door 28 and an above-freezing door 30 are hingedly mounted to the cabinet for closing the access openings. The doors 28, 30 of the appliance 20 have an exterior surface 32 and an interior surface 34 typically having a door liner. The refrigerator 20 also includes a rear wall section, a first side wall section 38, a second side wall section 40, a top 42, and a bottom 44. Although a side by side refrigerator is shown, it will be understood that the invention is not limited to such an arrangement.

An ice maker 50 is disposed within the freezer compartment 24. The ice maker 50 is an ice piece making apparatus which forms ice pieces, typically crescent shaped, although other shapes are conceivable. Such an ice maker 50 is taught in U.S. Pat. No. 7,278,275 entitled, "MECHANISM FOR DISPENSING SHAVED ICE FROM A REFRIGERATION APPLIANCE" the disclosure of which is incorporated herein by reference. The ice is then transferred to the ice manipulation module 10.

Figure 3A:
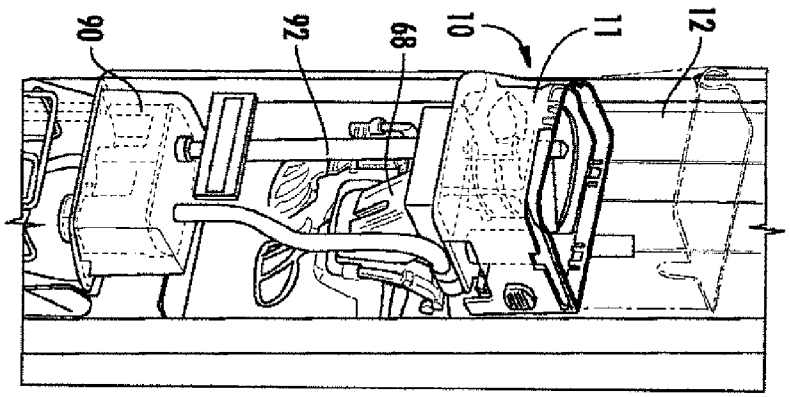
FIG. 3A is a top perspective view of the ice manipulation module.
Figure 3B:
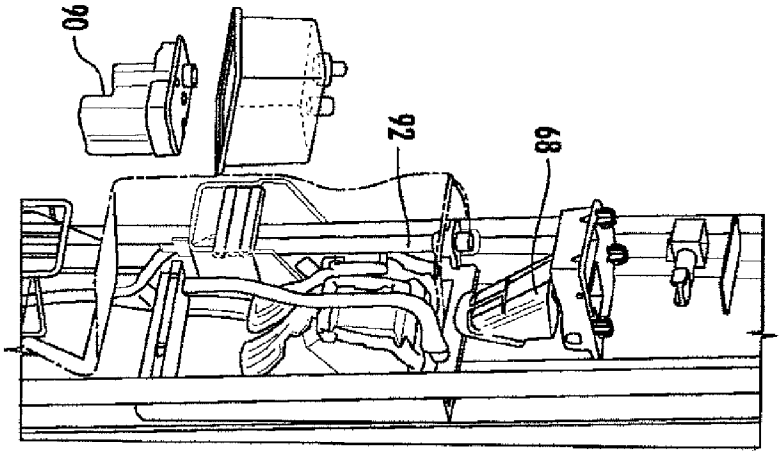
FIG. 3B is a top perspective view of a motor located within an appliance.
Figure 4:
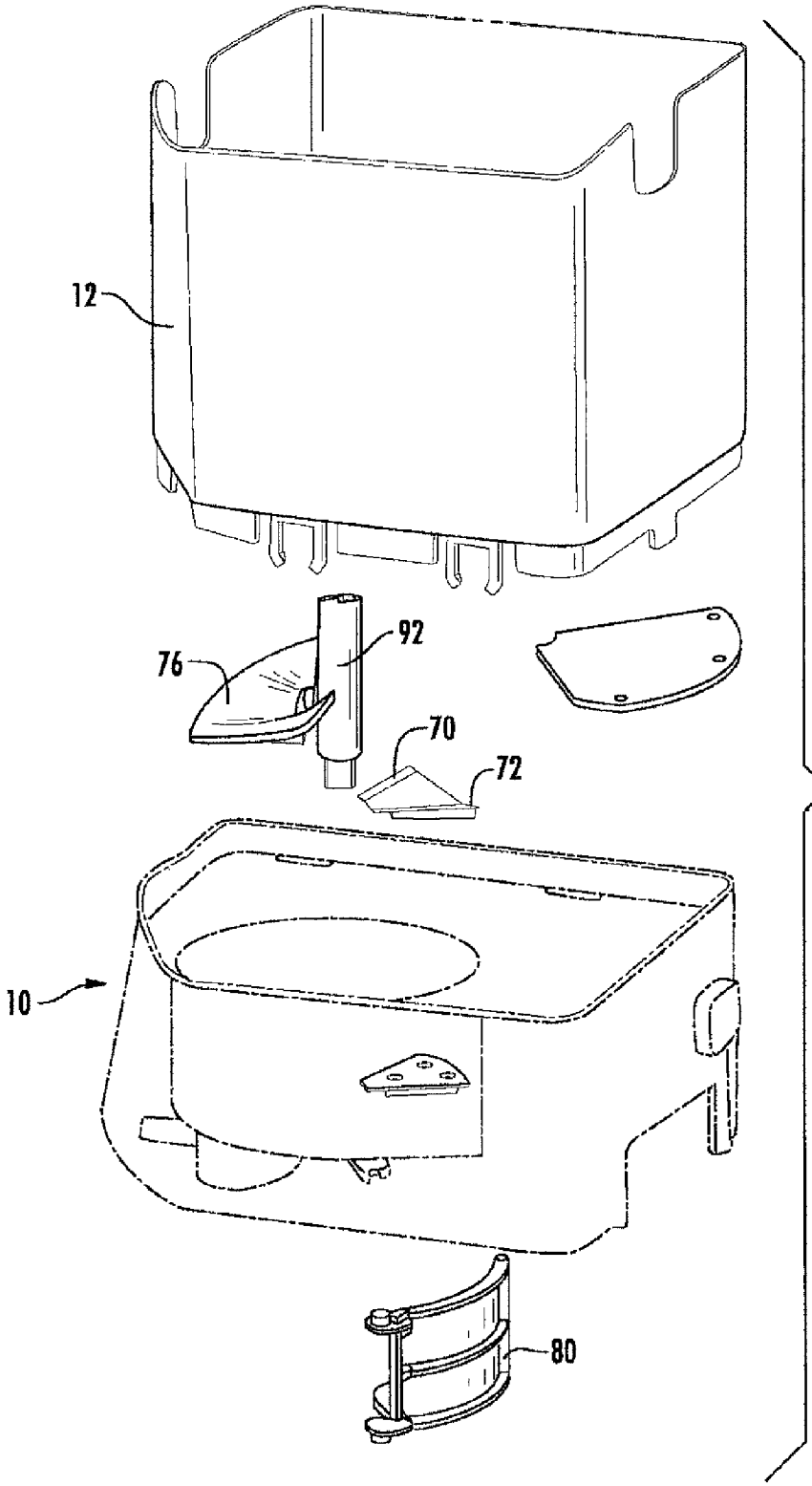
FIG. 4 is a top perspective exploded view of the ice manipulation module.
Figure 5:
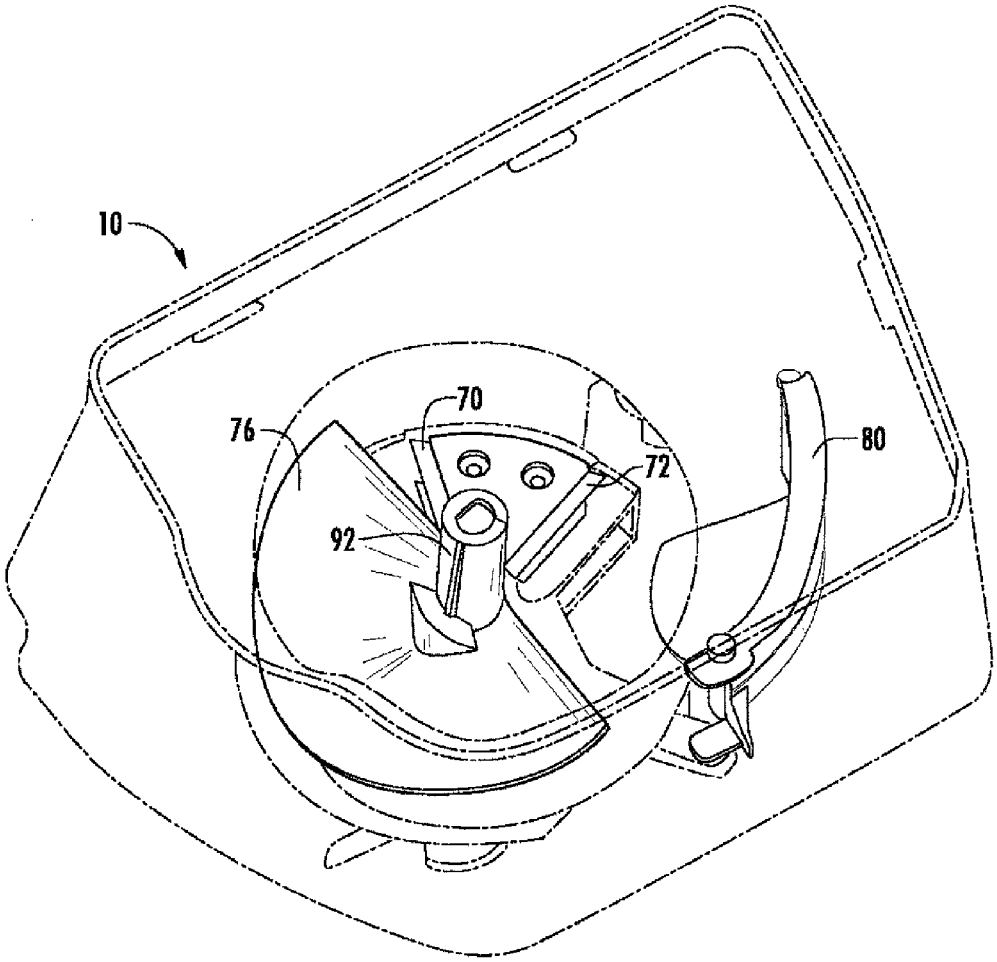
FIG. 5 is a top plan view of the ice manipulation module.
Figure 6:
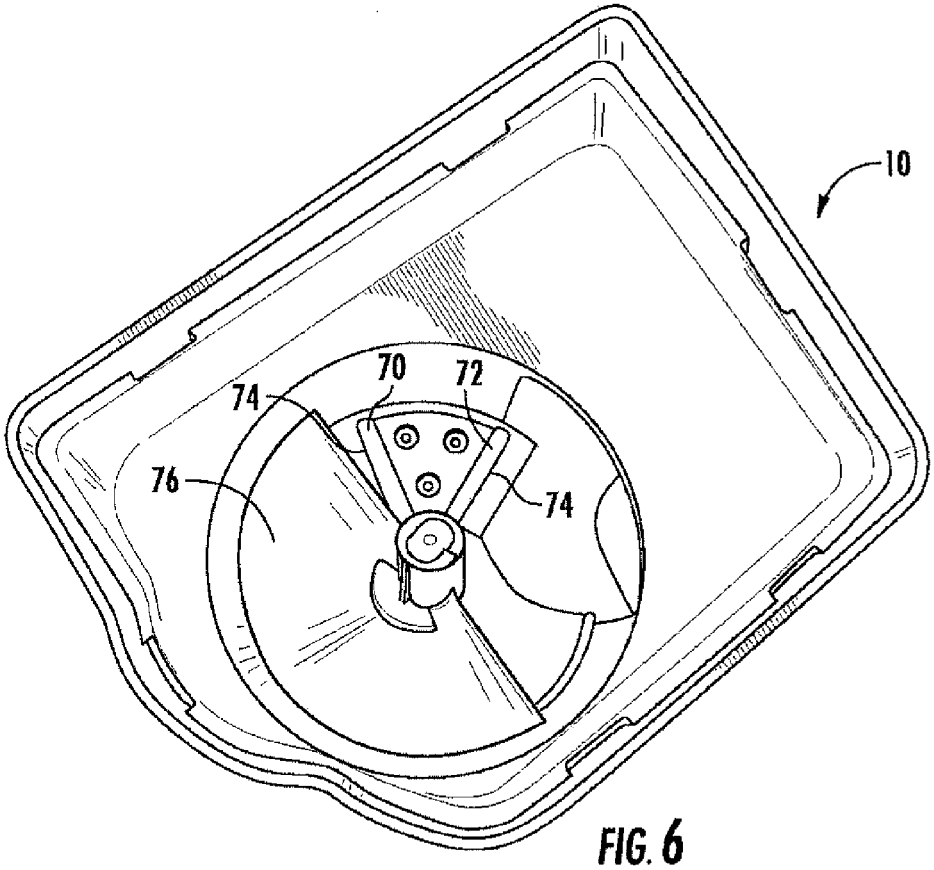
FIG. 6 is a top plan view of the ice manipulation module including at least one ice modification member.
Figure 7:
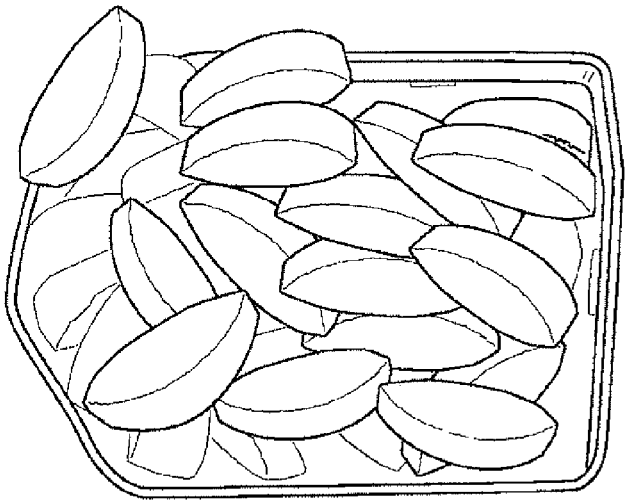
FIG. 7 is a top plan view of the ice manipulation module containing a plurality of ice pieces.

In one embodiment, as shown in FIGS. 3A and 3B, the ice manipulation module 10 may removably engage directly to the freezer door 28 and is typically positioned below the ice maker 50 for receiving ice pieces therefrom in a substantially vertical transfer; however, a substantially horizontal transfer of ice pieces from the ice maker 50 to the ice manipulation module 10 is conceivable. The ice manipulation module 10 includes a base 14 and at least one side wall. The side wall(s) may form a cylindrical shape or another geometric shape. Once the ice manipulation module 10 contains ice pieces, the ice manipulation module 10 is capable of modifying the pieces from their original, typically cubed form, into other forms of ice, thereafter dispensing the ice through a dispensing zone 60 when prompted by the user. Such ice manipulation is taught in U.S. patent application Ser. No. 12/636,905, entitled "THREE FUNCTIONS IN A SINGLE WELL," filed on Dec. 4, 2009, the disclosure of which is hereby incorporated by reference in its entirety. The user may prompt dispensing via a user interface 62 and/or a control mechanism 64 arranged to effect dispensing ice from the ice manipulation module 10 to the dispensing zone 60. The user interface 62 and the control mechanism also allow the user to selectively control the form of preferred ice to be dispensed. Specifically, the user may select dispensing of ice cubes, crushed ice, or shaved ice, either singularly or in combination, depending upon which ice modification module 10 is engaged to the appliance 20.

Figure 10:
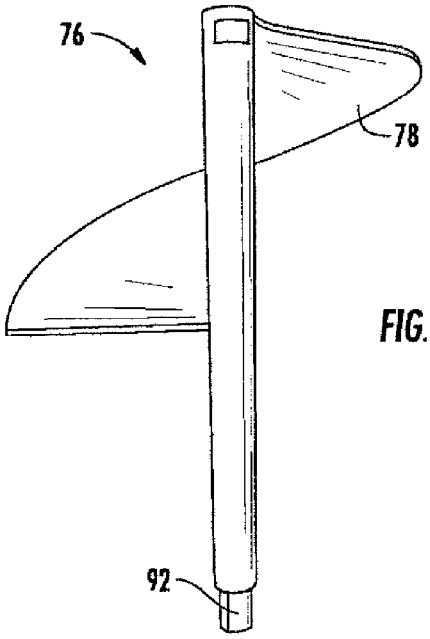
FIG. 10 is a front elevational view of one embodiment of an impeller having a helical geometry.
Figure 11:
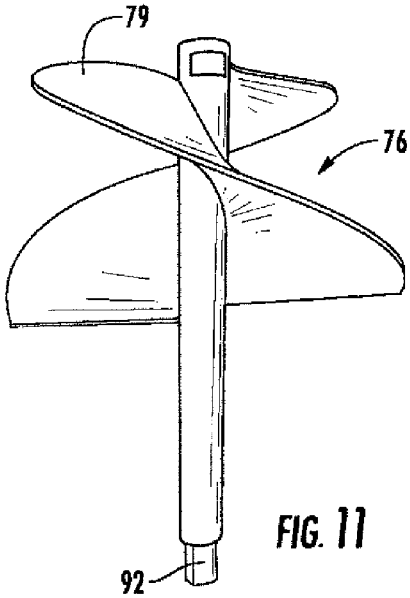
FIG. 11 is a front elevational view of anther embodiment of an impeller having a double helix geometry.
Figure 12:
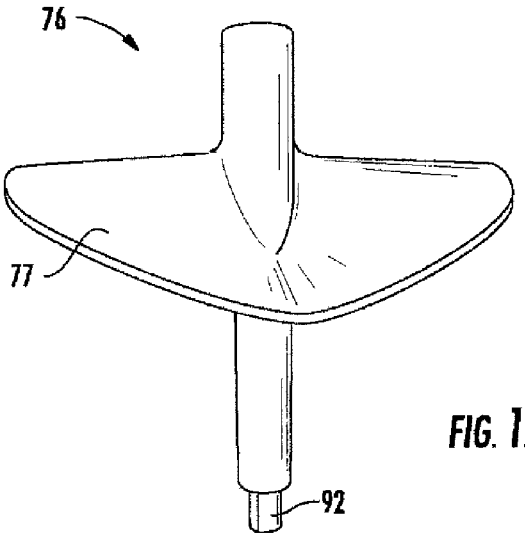
FIG. 12 is a front elevational view of another embodiment of an impeller having a shovel geometry.
Figure 13A:
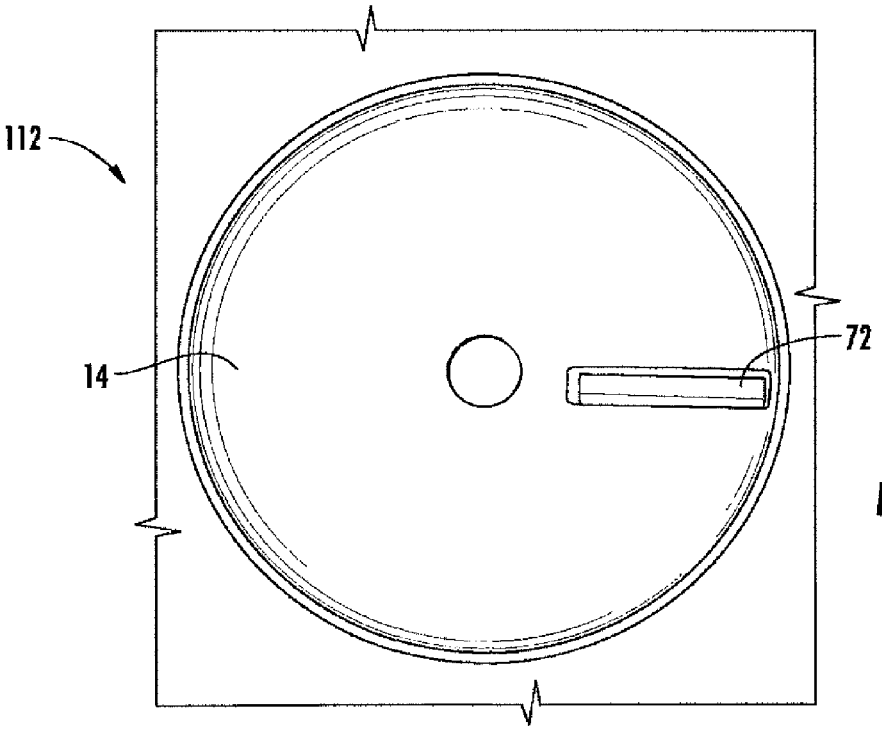
FIG. 13A is a top plan view of a shaved-cubed module.
Figure 13B:
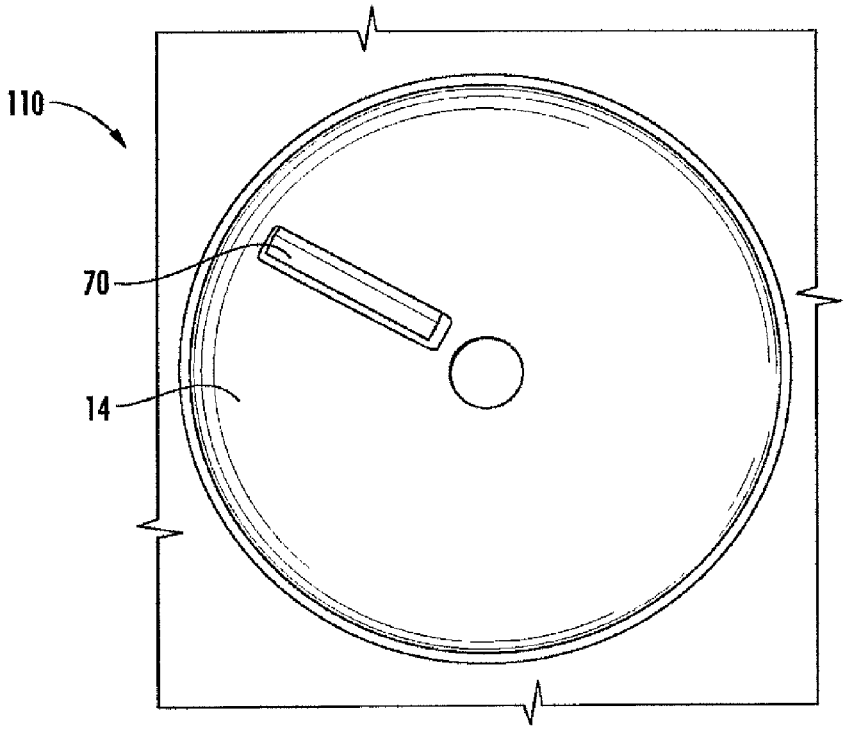
FIG. 13B is a top plan view of a crushed-cubed module.

The capability to provide at least three forms of ice is illustrated in FIGS. 4-9. Two forms of ice may be provided in a single ice manipulation module 10 when driven by a single motor 90. Therefore, all three forms of ice, namely crushed, shaved, and cubed, may be provided in the three possible combinations with three uniquely configured ice manipulation modules 10, as shown in FIGS. 13A-14B. Specifically, the present invention provides a crushed-cubed module 110 (FIG. 13B), a shaved-cubed module 112 (FIG. 13A), and a crushed-shaved module 114 (FIGS. 14A and 14B), collectively and generically referred to as the ice manipulation module 10. Each ice manipulation module 10 includes at least one ice modification member 70, 72, depending on which ice manipulation module 10 combination is present. Specifically, the ice manipulation module 10 includes a first ice modification member or a crushing blade 70 and/or a second ice modification member or a shaving blade 72. The crushing blade 70 and the shaving blade 72 are located proximate the base 14 of the ice manipulation module 10. The blades 70, 72 may be formed as one piece or may be completely separated. The illustrated examples show attachment of the blades 70, 72 to the base 14, but they may also be placed proximate, yet not attached, to the base 14, such that they are positioned to perform their crushing and shaving functions. The base 14 of the ice manipulation module 10 also includes an integrally formed trap door 80 or provides an operable connection to the trap door 80. The blades 70, 72 are positioned such that a leading edge 74 of each blade 70, 72 is configured to modify ice upon interaction with the ice pieces. Disposed within the ice manipulation module 10 is an impeller 76 that assists in facilitating the interaction of the ice pieces with the blades 70, 72. Specifically, the impeller 76 pushes the ice over the crushing or shaving blade 70, 72. The impeller 76 may have a variety of geometric configurations, including, but not limited to, a shovel type shape 77, a single helical shape 78, or a multiple helical shape 79 (FIGS. 10-12). The shovel type shape 77 is similar to a shovel blade. The shovel type shape 77 may include slight arcuate angles, but a substantially level blade may be employed. The substantially symmetrical shape allows for efficient ice manipulation in two directions. The helical embodiments function differently when the impeller 76 is rotated in opposite directions. This may be advantageous, depending upon the ice manipulation module 10 geometry or function desired. The impeller 76 is driven by a motor 90 located within the appliance 20. The impeller 76 and the motor 90 may be connected directly or via an output shaft 92 that extends between the motor 90 and the impeller 76. This connection provides the impeller 76 the ability to rotate in two directions.

In the crushed-shaved module 114, the motor 90 rotates the impeller 76 in a first direction A and the geometry of the impeller 76 pushes the ice pieces in the first direction A, while simultaneously applying a downward force. This motion initiates the interaction of the ice pieces with the leading edge 74 of the crushing blade 70, thereby modifying the ice pieces to crushed ice, as previously defined. In a shaving mode, the motor 90 turns the impeller 76 in a second direction B and the geometry of the impeller 76 pushes the ice pieces in the second direction B, while simultaneously applying a downward force (FIGS. 13 and 14). This motion initiates interaction of the ice pieces with the leading edge 74 of the shaving blade 72, thereby modifying the ice pieces to shaved ice, as previously defined. As an alternative to rotating the impeller 76, the base 14 of the ice manipulation module 10 may be operably connected to the motor 90, such that the motor 90 is capable of rotating the base 14, thereby also rotating the blades 70, 72. This motion would also initiate the above-discussed interaction of the ice pieces with the leading edge 74 of the blades 70, 72, based on the downward force of the impeller 76.

Figure 8:
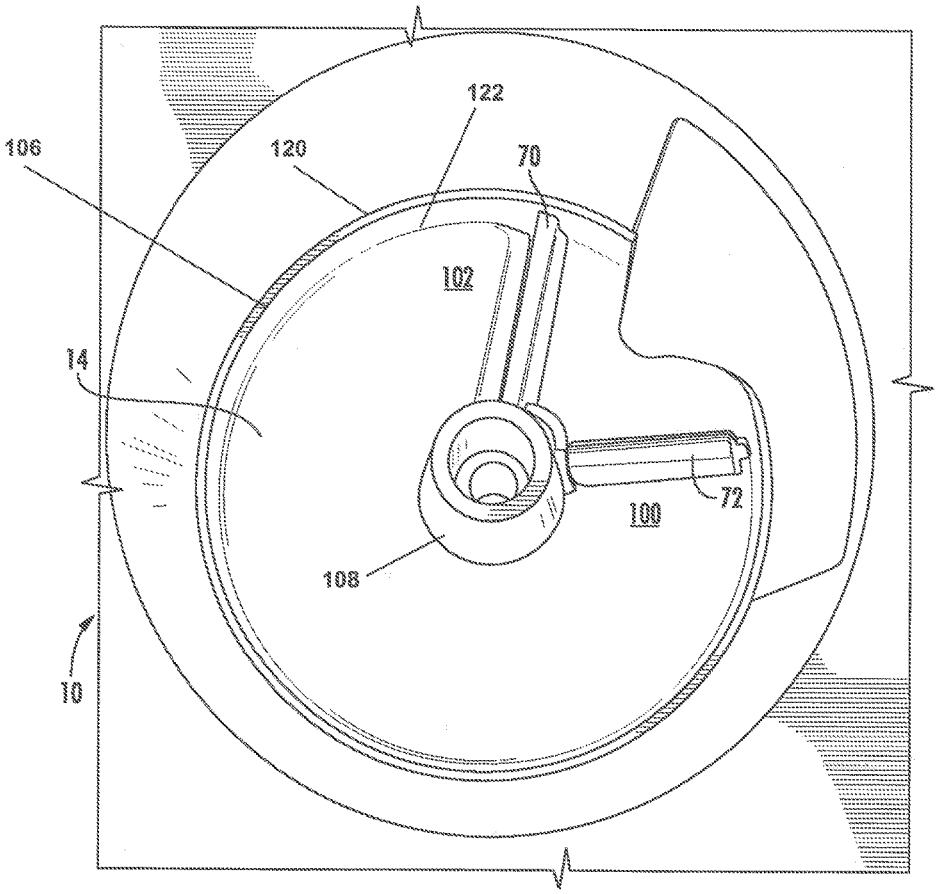
FIG. 8 is a top plan view of the ice manipulation module having a plurality of blades.
Figure 9:
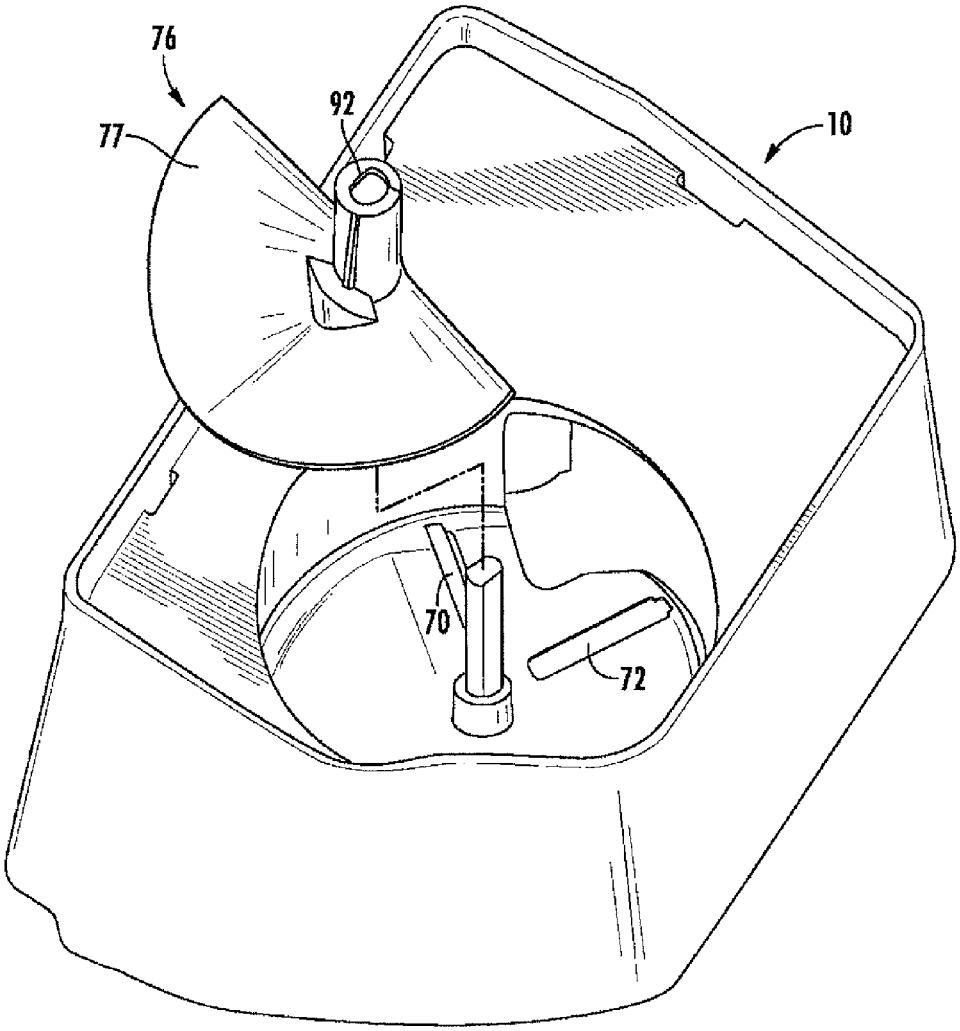
FIG. 9 is a top plan view of the ice manipulation module with the impeller removed from the shaft.
Figure 14A:
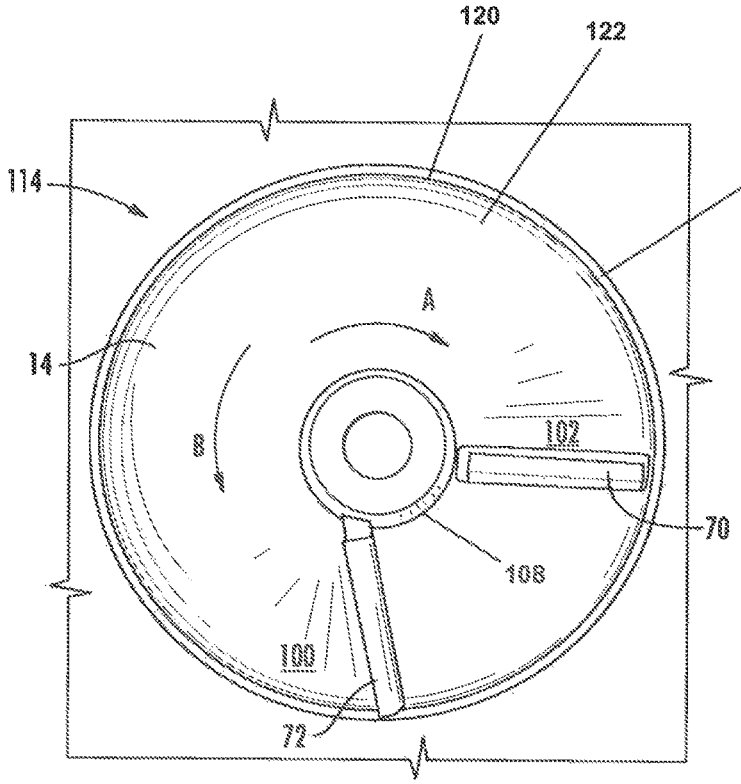
FIG. 14A is a top plan view of a crushed-shaved module.
Figure 14B:
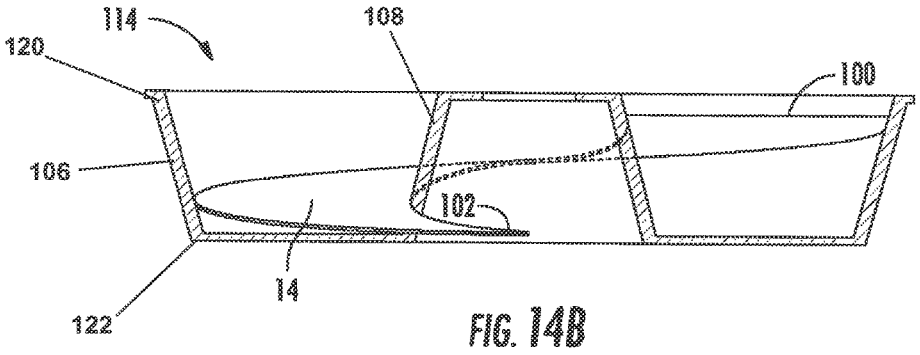
FIG. 14B is a side cross-sectional view of the crushed-shaved module.
Figure 17A:
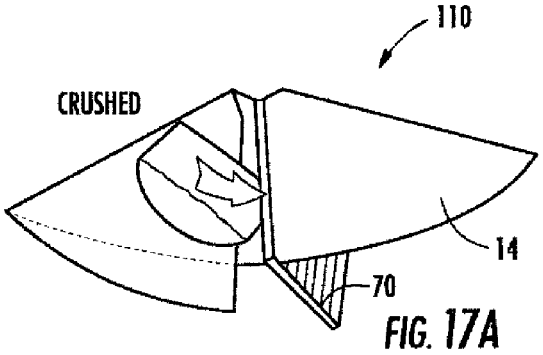
FIG. 17A is a top perspective view of the base having a crushing blade.
Figure 17B:
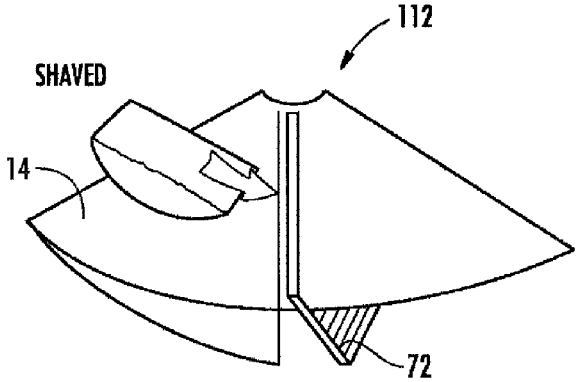
FIG. 17B is a top perspective view of the base having a shaving blade.
Figure 17C:
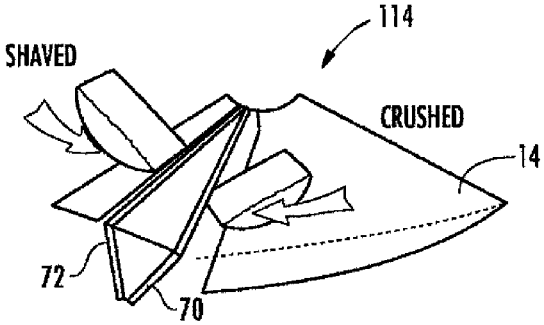
FIG. 17C is a top perspective view of the base having a crushing and shaving blade.

While it is conceived that similar sized blades 70, 72 may be employed to crush and shave if positioned at different angles, it is envisioned that the crushing blade 70 has a larger surface area than that of the shaving blade 72, based on the need to protrude deeper into ice pieces to effectively perform the crushing function. Conversely, the shaving blade 72 may only protrude slightly into the ice pieces, whereas too deep of a protrusion would result in an ice form not meeting the shaved ice parameter limitations as previously defined. Based on the need for a larger crushing blade 70, the base 14 of the ice manipulation module 10 descends from a base first level 100 to a base second level 102, as opposed to having a horizontally level base. Placing the crushing and shaving blades 70, 72 on a uniform horizontal base would result in a top edge of the crushing blade 70 to be positioned at a height greater than the shaving blade 72. Such a configuration may prevent the impeller 76 from most efficiently performing the pushing function, as the crushing blade 70 may interfere with the motion of the impeller 76. Therefore, a non-level base 14 allows for the accommodation of a larger crushing blade 70 to be placed at a position of the base 14 with a deeper or lower level than that of the shaving blade 72 position level. Such a base 14 configuration is illustrated in FIGS. 14A and 14B. The base 14 may descend gradually in a helical or spiral manner between an inverted frusto-conical outer side wall 106 and a frusto-conical center hub 108. As illustrated in FIGS. 8, 14A and 14B, the outer side wall 106 and the center hub 108 slope inward toward the base 14. The outer side wall 106 includes an upper edge 120 and a lower edge 122, where the circumference of the upper edge 120 is greater than the circumference of the lower edge 122. Part of the base 14 engages the outer sidewall 106 between the upper and lower edges 120, 122. In this arrangement, the shaving blade 72 is positioned proximate the first level 100 and near the upper edge 120, with the leading blade edge 74 facing in the direction of the base 14 descending direction. The base 14 descends gradually until reaching a lower most second level 102 near the lower edge 122. The crushing blade 70 is positioned proximate the second level 102, with the crushing blade 70 top edge positioned proximate the same height and/or plane of that of the shaving blade 72 top edge. Subsequent to shaving or crushing, the ice may be dispensed under the blade 70, 72, into the dispensing zone 60, as shown in FIGS. 17A-17C. As an alternative to a gradual descent, the ice manipulation module 10 base 14 may accommodate the crushing blade 70 by having at least one step down from the base first level 100 to the base second level 102.

Both the crushed-cubed module 110 and the shaved-cubed module 112 typically only include one ice modification member 70 or 72, specifically the crushing blade 70 or the shaving blade 72. The manner in which ice pieces are crushed and shaved has been previously described in the crushed-shaved module 114 discussion. The crushed-cubed module 110 and the shaved-cubed module 112 typically have a substantially horizontal base 14, based on the lack of a need for accommodation of the differently sized blades 70, 72. In order to provide a user with a cubed form of ice, the base 14 includes a trap door 80 that allows unmodified ice pieces (typically in the form of cubes) to fall through the trap door 80 to the dispensing zone 60. Based on the presence of only one ice modification member 70 or 72, where the member 70 or 72 has only one leading edge 74, the ice simply glides over the dull non-leading edge when rotated in the direction opposite the leading edge 74, thereby leaving the ice pieces in their unmodified form.

Figure 15:
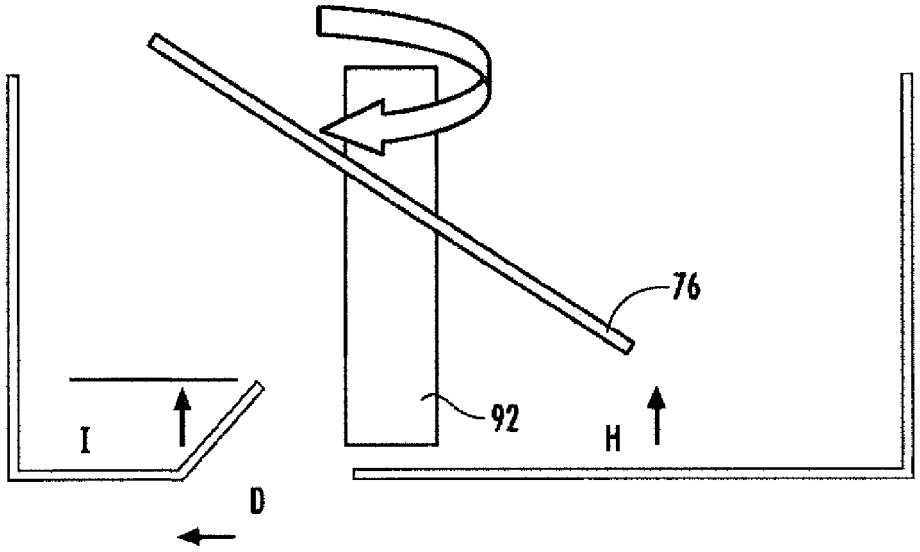
FIG. 15 is a front elevational view of the ice manipulation module illustrating ice modification parameters.

The positioning and geometry of the blades 70, 72 are critical factors in the shaving and crushing system. The physics behind such a system is illustrated in FIG. 15. The blade height (I) determines the thickness of the crushed piece, such that the greater the blade height, the thicker the crushed piece. Testing has determined that shaved ice is effectively produced with a blade height (I) of approximately two millimeters (2 mm), while crushed ice is effectively produced with a blade height (I) of approximately seven to nine millimeters (7-9 mm). The drop gap (D) regulates the piece size. Such regulation is accomplished based on the fact that no piece larger than the drop gap (D) may be dispensed to the user. Shaved ice will typically have a drop gap (D) of approximately six millimeters (6 mm), when used in conjunction with the aforementioned two millimeter (2 mm) blade, while crushed ice may require a drop gap (D) of approximately fourteen to eighteen millimeters (14-18 mm). An impeller gap (H) defines the minimum ice height available to push the ice around the ice manipulation module 10.

Figure 16:
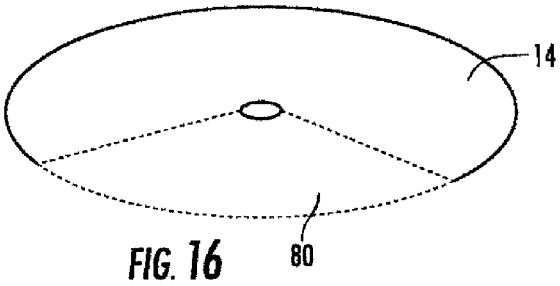
FIG. 16 is a top perspective view of a base having a trap door.

As discussed previously, the base 14 also includes the trap door 80 that allows for the dispensing of ice. Typically, the trap door 80 will lead to the dispensing zone 60, such as a chute 68. As illustrated in FIG. 16, the trap door 80 may be hingedly attached about a substantially vertical or a substantially horizontal axis. During the crushing or shaving mode, the trap door 80 remains in a closed position, whereas the trap door 80 is opened during dispensing of ice in a cubed form. A solenoid or some other mechanical or electromechanical device may be used to open the trap door 80, as controlled by the user interface 62 and/or the control mechanism.

Figure 18:
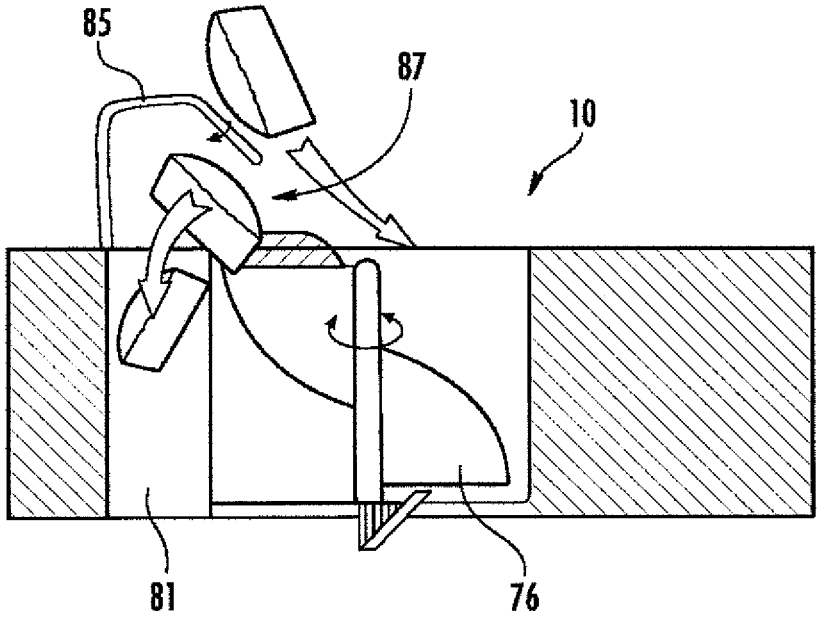
FIG. 18 is a front elevational view of the ice manipulation module illustrating an ice channel for dispensing ice.

Referring to FIG. 18, as an alternative or in addition to a hingedly attached trap door 80, cubed ice may be dispensed via an ice channel 81. The ice channel 81 is located adjacent to the ice manipulation module 10 and is formed by an upper covering 85. The upper covering 85 may be downwardly angled to allow ice pieces to fall into the ice manipulation module 10 from the ice maker 50. An opening 87 between the upper covering 85 and the ice manipulation module 10 is large enough to allow cubed ice to pass through and enter the ice channel 81. Cubed ice may be dispensed through the ice channel 81 when the impeller 76 is rotated in a specific direction. Specifically, in the crushed-cubed module 110 and the shaved-cubed module 112, when the impeller 76 is rotated in the direction opposite that of the crushing direction or the shaving direction, the impeller 76 forces cubed ice upwardly into the opening 87 and down through the ice channel 81.

In another embodiment, the ice manipulation module 10 removably engages a reservoir 12 that is mounted to the appliance 20, typically at the interior surface 34 of the freezer door 28. The reservoir 12 is positioned below the ice maker 50 and is capable of storing ice pieces. The ice manipulation module 10 may engage the reservoir 12 to provide functional capability of ice manipulation into three forms, namely crushed, shaved, and cubed.

A further aspect of the present invention is to provide a method of making an appliance 20. The method includes the step of forming a module-receiving area adapted to engageably receive at least one of a plurality of ice manipulation modules 10 selected from the group consisting of a crushed-cubed module 110, a shaved-cubed module 112, and a crushed-shaved module 114, wherein each one of the plurality of ice manipulation modules 10 includes at least one ice modification member. Provided is a motor 90 having an output shaft 92, adapted for rotation in a first direction and adapted for rotation in a second direction. An impeller 76 is connected to the output shaft 92 and is extended proximate the module-receiving area, wherein rotation of the output shaft 92 in the first direction causes a first ice manipulating condition and wherein rotation of the output shaft 92 in the second direction causes a second ice manipulating condition.

Advantageously, the present device provides the ability to dispense three forms of ice to a user from a single source. This ability improves on issues of spatial restraints within appliances.

It is to be understood that variations and modifications can be made on the aforementioned structure without departing from the concepts of the present device, and further it is to be understood that such concepts are intended to be covered by the following claims unless these claims by their language expressly state otherwise.

What is claimed is:

1. An appliance comprising:

an ice manipulation reservoir capable of receiving ice and defined by an inverted frusto-conical outer side wall, a frusto-conical center hub and a base having a helical surface spaced between the frusto-conical center hub and the inverted frusto-conical outer side wall, wherein the base includes a first level of the helical surface descending gradually to a second level of the helical surface, and wherein the inverted frusto-conical outer side wall and frusto-conical center hub slope inward toward the base;

a first ice modification member attached directly to the base proximate the first level, and a second ice modification member attached directly to the base proximate the second level;

a trap door attached to the ice manipulation reservoir operable between an open ice cube delivery position and a closed ice shaving or ice crushing position;

first and second drop gaps disposed proximate the first and second ice modification members, respectively, wherein the first and second drop gaps are configured to deliver shaved and crushed ice, respectively, to a user when the trap door is in the closed ice shaving or ice crushing position;

a motor operably connected with the ice manipulation reservoir and including an output shaft; and an impeller connected with the output shaft proximate the first and second ice modification members, the impeller configured to move in a first rotational direction, and a second rotational direction, and in a first rotational speed and a second rotational speed, the first rotational speed being faster than the second rotational speed.

2. The appliance of claim 1, wherein the impeller includes a shovel-type shape having a central portion and first and second side sections that descend from respective first and second edges to the central portion which is closer to the base than the first and second edges, wherein the first side is configured to force ice in a downward direction in the first rotational direction and the second side is configured to force ice in a downward direction in the second rotational direction.

3. The appliance of claim 1, wherein the impeller includes a single helical blade.

4. The appliance of claim 1, wherein the impeller includes a plurality of helical blades.

5. The appliance of claim 1, wherein the first ice modification member is an ice crushing blade attached to the second level of the helical surface of the base, and wherein the second ice modification member is an ice shaving blade attached to the first level of the helical surface of the base.

6. The appliance of claim 1, wherein the base includes a level portion proximate the second level configured to receive the first and second ice modification members, and wherein the appliance includes a door having an interior surface and an exterior surface, wherein the ice manipulation reservoir is mounted to the interior surface of the door.

7. The appliance of claim 1, wherein the first rotational direction defines a first ice manipulation condition, wherein the first ice manipulation condition includes one of crushing and shaving, and wherein the second rotational direction defines a second ice manipulation condition, wherein the second ice manipulation condition includes the other of crushing and shaving, and wherein the second rotational speed defines a cubed ice manipulation condition and wherein the ice is dispensed to a user through the trap door.

8. The appliance of claim 1, the appliance further comprising:

a user interface arranged to allow a user to actuate dispensing of ice in a form selected from a group consisting of crushed, shaved, or cubed.

9. An ice modification mechanism comprising:

an ice manipulation reservoir having a side wall and a base, wherein the base includes a sloped surface having a first level descending gradually to a second level, and wherein the side wall includes an upper circumference and a lower circumference, where the upper circumference is greater than the lower circumference, and wherein at least a portion of the base engages the side wall between the upper and lower circumferences, and wherein the first level of the base engages the side wall closer to the upper circumference than the second level of the base;

at least one ice modification component disposed inside the ice manipulation reservoir, wherein the at least one ice modification component is attached directly to the base at least partially between the first level and the second level of the base;

a trap door attached to the ice manipulation reservoir operable between an open position and a closed position, wherein the trap door is configured to deliver cubed ice when the trap door is in the open position;

two drop gaps disposed proximate the at least one ice modification component and configured to deliver formed ice when the trap door is in the closed position;

a motor operably connected with the ice manipulation reservoir and including an output shaft, wherein the motor includes a first rotational speed and a second rotational speed, and wherein the first rotational speed is greater than the second rotational speed; and an impeller connected with the output shaft proximate to the at least one ice modification component, the impeller being operable between a first rotational direction, and a second rotational direction.

10. The mechanism of claim 9, wherein the impeller includes a shovel-type shape that is configured to force the formed ice in a downward direction in both the first rotational direction and the second rotational direction.

11. The mechanism of claim 9, wherein the impeller includes a single helical blade.

12. The mechanism of claim 9, wherein the impeller includes a plurality of helical blades.

13. The mechanism of claim 9, wherein the at least one ice modification component includes a first ice modification member and a second ice modification member, the first ice modification member is an ice crushing blade, and wherein the second ice modification member is an ice shaving blade.

14. The mechanism of claim 9, wherein the base includes a spiral-type surface and wherein the mechanism is generally disposed within a housing having a door, wherein the door includes an interior surface and an exterior surface, wherein the mechanism is mounted to the interior surface of the door.

15. The mechanism of claim 14, wherein the first rotational direction defines a first ice manipulation condition, wherein the first ice manipulation condition includes one of crushing and shaving, and wherein the second rotational direction defines a second ice manipulation condition, wherein the second ice manipulation condition includes the other of crushing and shaving, and wherein the second rotational speed of the motor defines a cubed ice manipulation condition, and wherein ice is dispensed to a user through the door.

16. The mechanism of claim 9, the mechanism further comprising:

a user interface arranged to allow a user to actuate dispensing of ice in a form selected from a group consisting of crushed, shaved, or cubed.

17. A method of making an ice modification mechanism comprising steps of:

providing an ice manipulation reservoir having an outer wall including upper and lower edges, a base having a helical surface and two drop gaps, and a trap door operable between open and closed positions, wherein the upper edge has a greater circumference than the lower edge, and wherein the base engages the outer wall between the upper and lower edges;

forming a first level and a second level of the helical surface of the base, wherein the first level descends gradually to the second level;

installing at least one ice modification component having a shaving blade and a chopping blade, wherein the at least one ice modification component is attached directly to the base proximate at least one of the first level of the base and the second level of the base, wherein one of the two drop gaps is positioned proximate the shaving blade and the other of the two drop gaps is positioned proximate the chopping blade;

providing a motor having an output shaft;

connecting an impeller to the output shaft, wherein the impeller includes a first rotational direction, a second rotational direction, a first speed and a second speed; and extending the impeller into the ice manipulation reservoir.

18. The method of claim 17, wherein the impeller comprises a shovel-type shape that is configured to force ice in a downward direction in both the first rotational direction and the second rotational direction.

19. The method of claim 17, further comprising the step of:

connecting the motor to a user interface actuated by a user to control operation of the motor between the first and second rotational directions and the first and second speeds.

20. The method of claim 17, further comprising the steps of: forming shaved ice by rotating the impeller in the first rotational direction at the first speed such that the impeller moves ice across the shaving blade and directs shaved ice pieces down one of the two drop gaps;

forming chopped ice by rotating the impeller in the second rotational direction at the first speed such that the impeller moves ice across the chopping blade and directs chopped ice pieces down the other of the two drop gaps; and moving cubed ice pieces by rotating the impeller at the second speed, wherein the impeller directs the cubed ice pieces through the trap door disposed in the open position; and providing an ice maker capable of introducing cubed ice pieces to the ice manipulation reservoir.

* * * * *